US005324358A

United States Patent [19]

Tseng

[11] Patent Number: 5,324,358

[45] Date of Patent: Jun. 28, 1994

[54] OILING FRAME FOR CHEMICAL FIBRE MACHINES

[76] Inventor: Ching K. Tseng, 34, 112 Lane, Sy Yuan Rd., Hsin Chuang, Taiwan

[21] Appl. No.: 917,404

[22] Filed: Jul. 23, 1992

[51] Int. Cl.[5] ..... B05C 5/00

[52] U.S. Cl. ..... 118/670; 118/712; 118/36; 118/325; 427/8; 73/160; 83/80; 83/371; 83/522.26; 83/950

[58] Field of Search ..... 118/670, 712, 36, 325; 427/8; 73/160; 83/80, 371, 522.26, 950

[56] References Cited

U.S. PATENT DOCUMENTS

| | | | |
|---|---|---|---|
| 643,041 | 2/1900 | Coddington | 118/36 |
| 3,797,089 | 3/1974 | Abel | 118/325 |
| 3,886,894 | 6/1975 | Brekle | 118/670 |
| 4,412,505 | 11/1983 | Haüsler et al. | 118/325 |
| 4,711,121 | 12/1987 | Takara et al. | 73/160 |
| 5,118,008 | 1/1993 | Aemmer | 73/160 |

FOREIGN PATENT DOCUMENTS

| | | | |
|---|---|---|---|
| 1441312 | 11/1968 | U.S.S.R. | 73/160 |

*Primary Examiner*—W. Gary Jones

*Assistant Examiner*—Todd J. Burns

*Attorney, Agent, or Firm*—Bacon & Thomas

[57] ABSTRACT

The present invention relates to an oiling frame for chemical fibre machines in which signal emitted by a sensor disposed above the filament bobbin winding machine of the chemical fibre machine for detecting broken filaments in any fibre strand is received by a cylinder for the same to actuate a set of blades below oil nozzles in the oiling frame so that the blades may instantaneously and simultaneously cut the fibre strands moving downward from the oil nozzles. Since the blades and the blade covers are designed to have several sharp edges which facilitate quicker and more precise cutting thereof while the blades can be economically made of non-expensive metal material. Furthermore, the present invention includes a specially structured oil nozzle assemblage which is angle-adjustable and can therefore, when used in conjunction with an inclined airflow guide board above the oil nozzle assemblage, help the drifting fibre strands to be effectively and evenly coated with filament oil (reactive agent) sprayed by the nozzles and thereby enhance the toughness of the filaments and the fibre strands, accordingly.

4 Claims, 6 Drawing Sheets

OILING FRAME FOR CHEMICAL FIBRE MACHINES

BACKGROUND OF THE INVENTION

The present invention relates to an oiling frame for chemical fibre machines in which multiple integrally formed blades are Provided at Positions suitable for cutting strands of filaments so that the blades may simultaneously and instantaneously cut the strands when broken filaments are found therein; the Present invention also relates to an angle-adjustable oil nozzle assemblage and an airflow guide board Provided in the oiling frame which may correct the direction of the cooling air and irregular airflow caused by strands moving down at high speed lest they should have reverse influence on the even oiling of filaments.

In the manufacture of chemical fibres for textiles, petrochemical raw material is fused in the chemical fibre machine and is extruded from a filament extruding head under high Pressure and drawn to form filaments. The extruded filament are cooled, oiled, and gathered to form fibre strands, the strands are then wound to form fibre bobbins to complete the manufacture of chemical fibres. In the above-described Process, however, filaments in strands are apt to break due to factors existed inside the machine or outside environment. Strands containing broken filaments shall have inferior quality. To find out the strands containing broken filaments as earlier as possible and to timely stop and adjust the machine, it is necessary to equip the chemical fibre machine with broken filaments detecting means and fibre strands cutting means.

In the existing similar machines or equipments, a kind of sensor, such as an electric eye, is used as the broken filaments detecting means. The sensor shall sense the change in the diameter of strands when there is any broken filaments and generates a control signal which is sent to the fibre strands cutting means for the same to cut the strands. In a commonly used oiling frame, there are fixed amounts of production lines for the formation of strands (such as the 4th, 6th, 8th spindles, etc. that are marked with even number) and the strands in such groups of Production line are usually wound to form the fibre bobbins by the same winding shaft so that the fibre bobbins may have uniform quality. In the event any of the production lines is found to have broken filaments in the strands, other production lines in the same oiling frame must be cut and stopped at the same time to Prevent any inferior Product. The type of cutting means used for cutting the Production lines was usually a chisel-like blade. Each chisel-like blade corresponds to a production line. When a signal indicating broken filaments is received, the particular chisel-like blade shall individually cut the corresponding production line and power to other filaments in the same oiling frame is disconnected by operator so that the machine may be re-adjusted. However, the cutting edge of the chisel-like blade is apt to collapse after many times of impact and cutting. To give the blades longer duration, it is a common practice to use more expensive metal, such as ferrotungsten, as the material of the blades. Under the circumstances, the cost of equipment is increased. Furthermore, frequent replacement of such blades shall have reverse influence on the overall production.

Moreover, the filaments must be cooled by cooling air after they were drawn to form filaments under high pressure so as to enhance their toughness. Since the formed filaments are extremely thin, they are apt to drift when they are exposed to the cooling air. When drifting filaments pass an oil nozzle, it is unable for the filament oil (reactive agent) to effectively and evenly coat the filaments, that is, it will be difficult to maintain filaments of uniform quality and therefore, the filaments are apt to break and have poor tensibility.

SUMMARY OF THE INVENTION

The primary object of the present invention is to provide a fibre strand cutting device below the oiling device in the oiling frame. The cutting device consists of multiple integrally formed blades (or replaceable blades) and a blade cover set. The integrally formed blades are laterally movable under the control of a cylinder. A plurality of filament guide grooves having the same number as that of fibre strands are provided on the blade covers. The filament guide grooves are closed by the blades when the blades shift to cut the fibre strands. Multiple cutting edges are provided at blade slideways and each blade such that the fibre strands may be easily cut by the blades. Thus, even a blade made of common suitable material that is not so expensive may instantaneously cut the filaments while a lot of equipment cost is saved Moreover, since the blades are integrally formed on one piece, they shall be actuated to shift at the same time when the cutting device is moved by the cylinder which receives control signal from the sensor, that is, the fibre strands of every production lines are cut simultaneously that will insure consistent quality of wound fibre bobbins.

Another object of the present invention is to provide a uniquely designed turbulence-free precision oiling device in which an angle-adjustable oil nozzle assemblage is provided in the oiling frame. The angle-adjustable oil nozzle assemblage has a laterally projected flat plate at each end and each engages with a hook-shaped member with screws. The hook-shaped member each is further pivotly attached to a fixing bracket fixed to inner surface of two sidewalls of the oiling frame. When the hook-shaped members are pivotly adjusted, the angle of the entire nozzle assemblage may be changed. An airflow guide board is further provided in an upper position in the oiling frame so that the cooling air or irregular airflow may be guided to blow in a fixed direction. The angle of the oil nozzle assemblage may be adjusted depending on the direction in which the air is blowing, the strength of the airflow, and the drifting of the filaments such that the filament oil (reactive agent) may effectively and evenly coat the surface of the filaments and thereby enhances the toughness of the filaments.

DETAILED DESCRIPTION OF THE PREFERRED EMBODIMENTS

Figure 1:
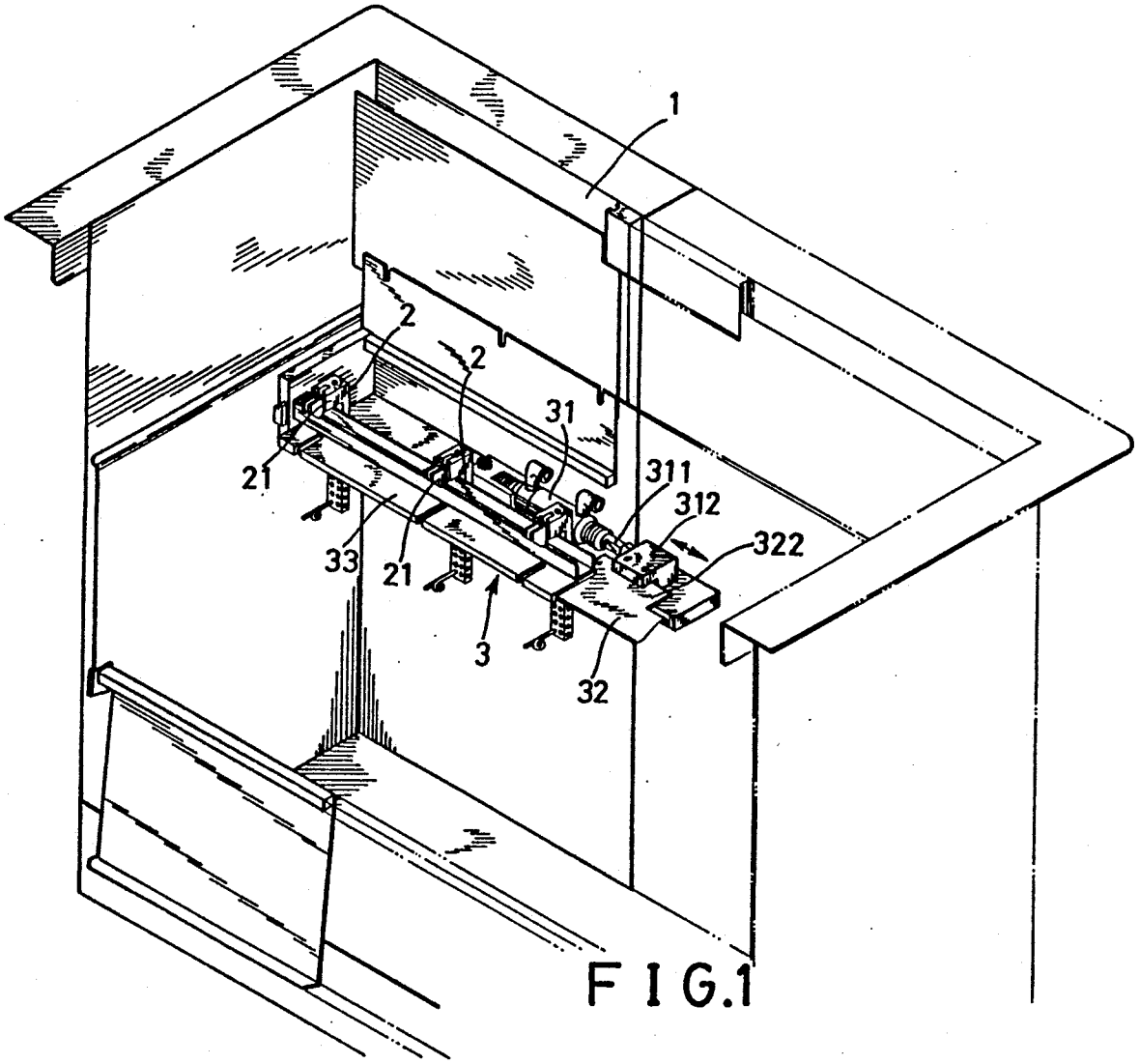
FIG. 1 is an assembled perspective view showing the position of the fibre strand cutting device according to the present invention in an oiling frame of an existing chemical fibre machine.

Please refer to FIG. 1. The fibre strand cutting device according to the present invention mainly refers to a fibre strand cutting device 3 mounted below an oiling device 2 in an oiling frame 1 of a common chemical fibre machine. In the oiling frame 1, there are still other parts, such as upper filament extruding heads, and cooling air vents (not shown), that are not included in the scope of the present invention and are therefore not discussed herein. A main part of the present invention is the fibre strand cutting device 3 below the oiling device 2. It is known that the main purpose of an oiling device 2 is to spray anionic agent from an oil nozzle 21 onto and thereby coats the surface of fibre strands to enhance the toughness of the filaments and the strands, accordingly. However, there are factors inside the chemical fibre machine, such as changes in the velocity and pressure of the cooling air, and factors of outer environment of the machine, such as overhigh ambient temperature, shall have influence on the filament breaking during the process the filaments are formed and gathered. The broken filaments tend to deteriorate the quality of the strands and cause broken yarns. Therefore, a sensor (not shown) is provided above a filament bobbin winding machine in the present invention to detect changes in the diameter of the strands. Whenever broken filaments in the strands are found, the sensor shall instantly generate and send a control signal to the fibre strand cutting device 3 for the same to cut the strands containing broken filaments, maintaining uniform strand quality.

Figure 2:
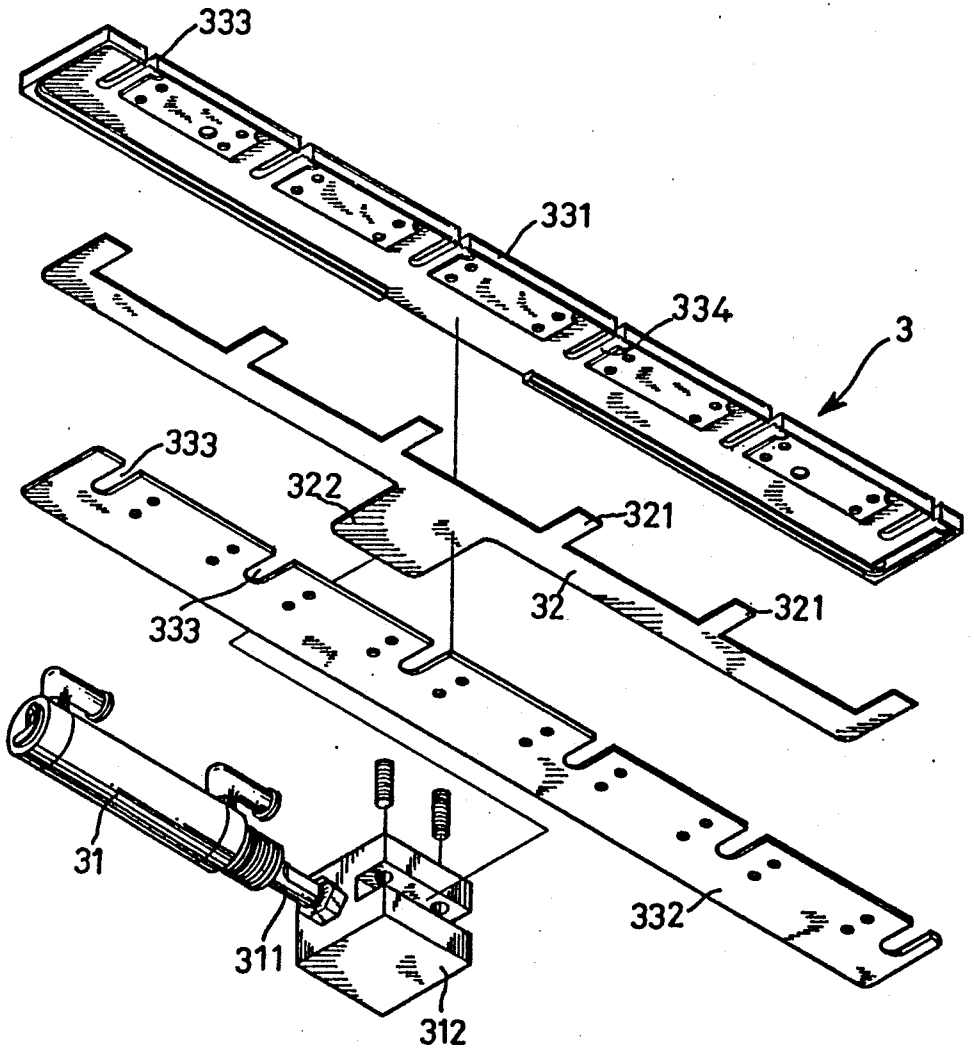
FIG. 2 is a disassembled perspective bottom view of the fibre strand cutting device of the present invention.

Please refer to FIGS. 1 and 2 for the detailed structure of the fibre strand cutting device 3. The fibre strand cutting device 3 mainly includes a control cylinder 31, a cutting member 32, a blade cover set 33 consisting of an upper blade cover 331 and a lower blade cover 332. The control cylinder 31 has a piston 311 which shall laterally shift when the control cylinder 31 receives a signal generated and sent by the sensor. The blade member 32 has multiple blades 321 integrally formed on one single piece. The number of the blades 321 corresponds to that of fibre strands on each oiling frame 1. A backward extended clamp plate 322 is formed on one side of the cutting member 32 opposite to the blades 321 and is fixedly screwed to a [-shaped clamp member 312 attached to outer end of the piston 311 of the cylinder 31, permitting the cutting member 32 to shift leftward following the movement of the piston 311. The cutting member 32 is disposed between the upper blade cover 331 and the lower blade cover 332 while the blade cover set 33 is fixed below the oiling device 2. On both the upper and the lower blade covers 331, 332, fibre strand guide grooves 333 having the same number as the fibre strands are formed, and, strands are guided to pass therethrough to fibre bobbin winding machine below the cutting member 32. Underside of the upper blade cover 331 is formed of an inner recess for the cutting member 32 to slide therein. Blade slideways 334 are provided in the upper blade cover 331, each corresponding to a fibre strand guide groove 333 or each blade 321 such that the fibre strand guide grooves 333 may be opened or closed following the lateral shifting of the blades 321 relative to the upper blade cover 331. When the blades 321 shift relative to the upper blade cover 331 and close the fibre strand guide grooves 333, they together with the slideway 334 to produce a shearing effect which will instantaneously cut the strands passing therethrough.

Figure 3:
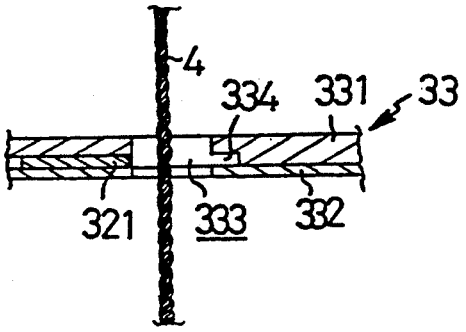
FIG. 3 shows the movement of the fibre strand cutting device under normal operation.
Figure 4:
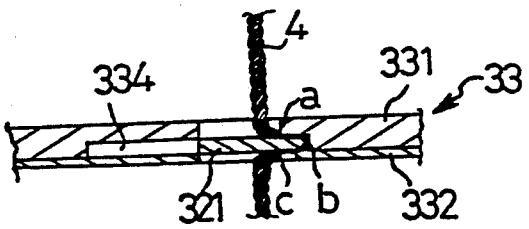
FIG. 4 shows the fibre strand cutting device of the present invention in a position to cut the fibre strand.

Please now refer to FIGS. 3 and 4 for the cutting movement. The blades 321 each has a sharp cutting edge formed at one lateral side adjacent to the fibre strand guide groove 333; the slideways 334 each also has sharp edges formed at where the sharp edge of the blades 321 shall, together with the blade slideway 334 to produce a shearing effect to cut the fibre strands. To cut the fibre strands 4, the blades 321 moves in the slideway 334 relative to the upper blade cover 331, the shearing force produced between the blades 321 and the corresponding slideways shall cut the strands 4. FIG. 3 shows a fibre strand 4 that is guided to move down through a fibre strand guide groove 333 in a normal operation state; and FIG. 4 shows a fibre strand 4 containing broken filaments is found and the manner in which the cutting device 3 operates. From FIG. 4, it can be seen that when the blade 321 shifts to cut the fibre strand 4, the fibre strand 4 will pass three cutting points a, b, and c formed between sharp edge of the blade 331 and shearing acute angles of the upper and the lower blade covers 331, 332. Since the strand 4 moves downward at a speed as high as 4,000 to 6,000 meters per minute, it will be instantaneously cut by the blade 321. Since the cutting member 32 of the present invention is an integrally formed multi-blade piece, all other fibre strands 4 of the same group shall be cut simultaneously and thereby insure the uniform quality of the wound filament bobbins.

Figure 5:
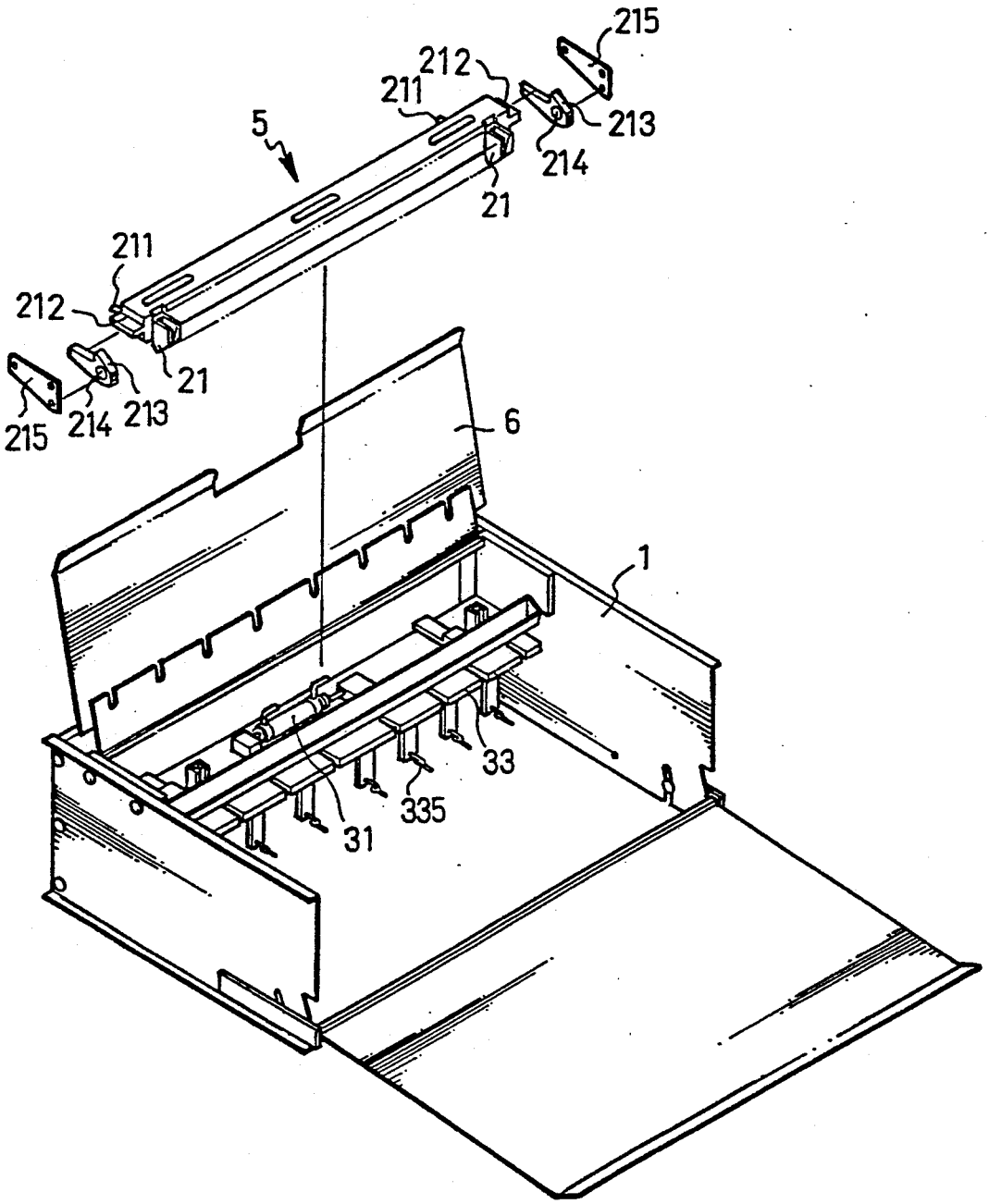
FIG. 5 is a disassembled perspective of the oiling device according to the present invention.

Please further refer to FIG. 5 for the detailed structure of the precision oiling device 2 for a chemical fibre machine. The precision oiling device 2 according to the present invention mainly includes an angle-adjustable oil nozzle assemblage 5 mounted in the oiling frame 1 of the chemical fibre machine. The oil nozzle assemblage 5 may be pivotly adjusted to a certain angle to match with the drifting fibre strands 4 as shown in FIG. 7, allowing the strands 4 to be evenly coated with the filament oil (reactive agent) to enhance the fibre strands' toughness.

Figure 6:
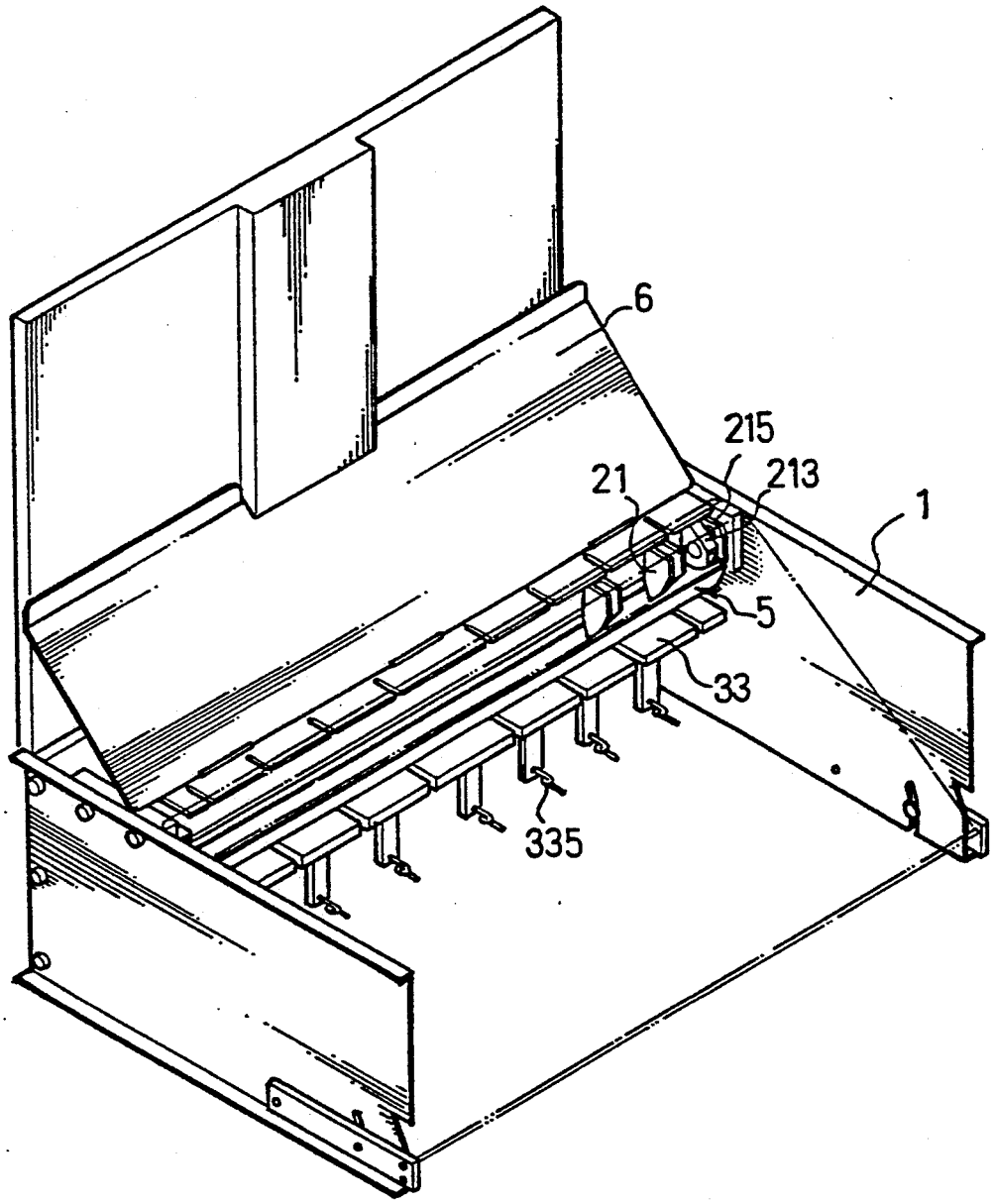
FIG. 6 is an assembled perspective of the oiling device having been installed in the oiling frame.

As shown in FIGS. 5 and 6, the oiling device 2 of the present invention mainly includes an angle-adjustable oil nozzle assemblage 5 mounted above the strand cutting blade cover set 33 and filament guide rings 335 in the oiling frame 1. The oil nozzle assemblage 5 consists of a frame on which a plurality of nozzles 21 are formed. The nozzle 21 each has a guide tube 211 extending backward from the rear portion of the nozzle 21 for supplying adequate amount of filament oil (reactive agent) to be sprayed onto surface of the fibre strand being guided down through the nozzle 21.

The angle-adjustable oiling device 2 is characterized by a laterally projected flat plate 212 at each end of the oil nozzle assemblage 5. Each of the flat plate 212 may be fixedly screwed to a hook-shaped member 213 to engage with a plane thereof parallel to the flat plate 212. A pivot hole 214 is formed at the hook-shaped side of the member 213 for pivotly connecting the hook-shaped member 213 to a fixing bracket 215 fixed to a sidewall of the oiling frame 1. By means of the fixing bracket 215, the hook-shaped member 213 may effectively pivotly turn. Since the oil nozzle assemblage 5 is fixedly screwed to the hook-shaped member 213, the pivot turning of the hook-shaped member 213 shall cause the oil nozzle assemblage 5 to pivotly turn to a desirably inclined angle. There is an airflow guide board 6 further provided in upper position of the oiling frame 1, inclined in a direction the same as that the cooling air blows. With this airflow guide board 6, cooling air and irregular airflow caused by the fibre strands moving down at high speed can be properly guided to form airflow blows in a regular direction steadily toward the fibre strands 4.

Figure 7:
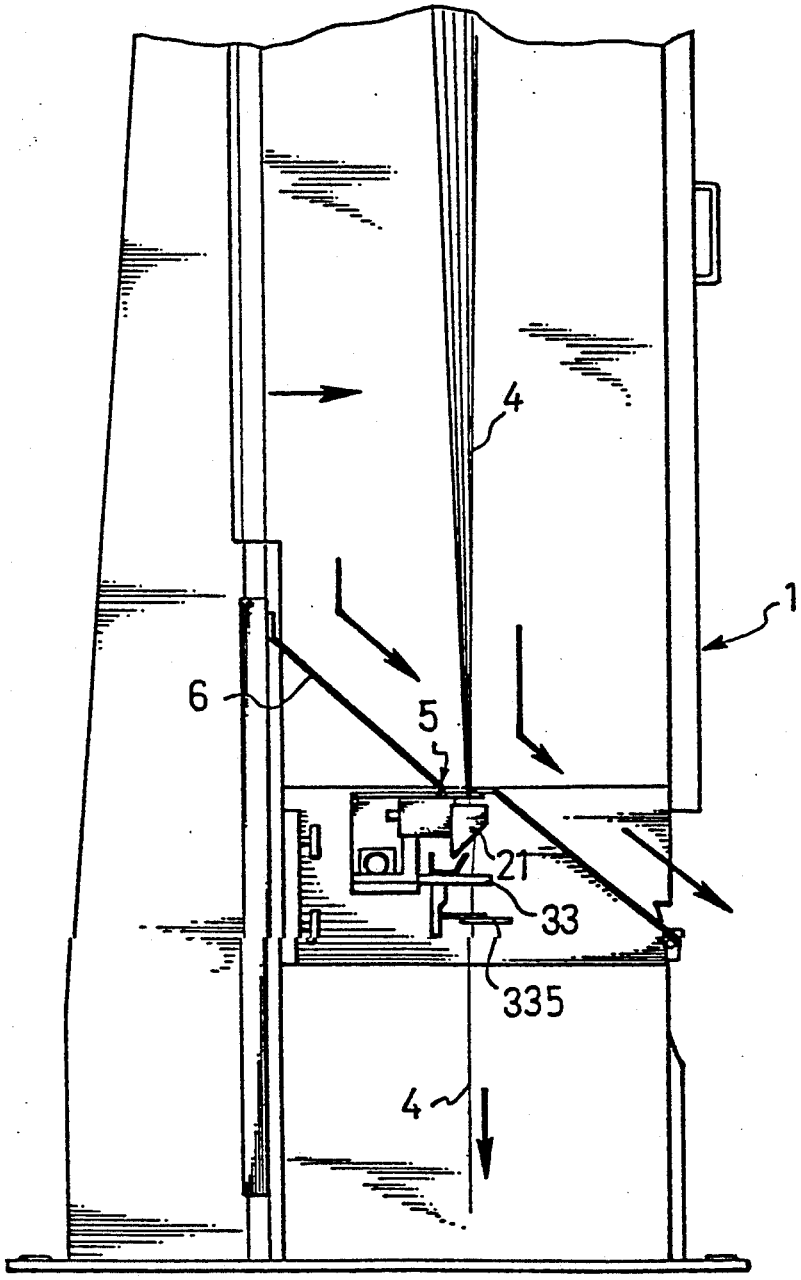
FIG. 7 is a side sectional view of the oiling device of the present invention showing the operation thereof.

Please refer to FIG. 7 for the operation of the oiling device 2. After the chemical fibre raw material is extruded to form filaments, the filaments are cooled by the cooling air which blows in a direction as indicated by the arrow in the figure. A part of the cooling air or irregular airflow shall become downward airflow blowing along the airflow guide board 6 toward the fine fibre strand 4. The cooling air frequently blows the strands 4 to drift and the drifting strands 4 will be difficult to be evenly and effectively coated with the filament oil (reactive agent) sprayed from the nozzles 21 when the fibre strands 4 passing through the nozzles 21. When the oil nozzle assemblage 5 is adequately adjusted to a certain angle so that the strands 4 are guided to pass through the nozzles 21 via proper position, allowing the filament oil (reactive agent) to fully and evenly coat the surface of the fibre strands 4 so as to enhance the toughness of the filaments and fibre strands 4, accordingly.

From the above description, it can be seen that the oiling frame for the chemical fibre machine according to the present invention may use an integrally formed one-piece multi-blade cutting member made of non-expensive metal material as well as the specially designed blade cover set for the cutting member to effectively and instantaneously cut strands containing broken filaments. A lot of cost of the equipment can be saved. Besides, when the one-piece multi-blade cutting member is used in conjunction with the pivotly turnable oil nozzle assemblage and the airflow guide board, the known drawback of uneven coating of reactive agent on drifting filaments can be improved.

It is to be understood that the form of the invention shown and disclosed is to be taken as a preferred embodiment of the invention and that various changes and modifications may be made without departing from the spirit of the invention or the scope of the subjoined claims.

What is claimed is:

1. An oiling apparatus for chemical fibre machines having a fibre strand cutting device and an angle-adjustable oiling device, said fibre strand cutting device being able to cut strands containing broken filaments when it receives a control signal given by a sensor disposed above a filament bobbin winding machine for detecting changes in the diameter of fibre strands, said fibre strand cutting device comprising: a control cylinder assembly, a cutting member, and a blade cover set comprising an upper blade cover and a lower blade cover, said control cylinder assembly having a piston and rod which are actuated to move with respect to said cylinder when said control cylinder assembly receives an actuating signal from said sensor;

said cutting member comprising a one-piece integrally formed multi-blade member, disposed between said upper blade cover and said lower blade cover, and having blades the number of which corresponds to the number of fibre strands in said oiling frame, and an extended clamp plate on a side opposite to said blades attached to said piston and rod of said control cylinder assembly so that said cutting member is laterally moved with said piston and rod when said piston and rod are moved;

said blade cover set being fixed to the chemical fibre machine; said upper and said lower blade covers having formed therein fibre strand guide grooves the number of which is the same as that of the fibre strands in said oiling apparatus; said upper blade cover further having an inner recess formed in an underside defining blade slideways for said cutting member to move therein, corresponding to each of said fiber strand guide grooves.

said blades are sliding within one of said blade slideways relative to said upper and said lower blade covers such that said fibre strand guide grooves are closed or opened by said shifted blade in said blade slideway;

said fibre strands passing through said fibre strand guide grooves are instantaneously cut by a shearing force produced from a shear effect when said blades shift in said blade slideways relative to said upper and said lower blade covers to close said fibre strand guide grooves;

said angle-adjustable oiling device comprising an angle-adjustable oil nozzle assemblage provided above said fibre strand cutting device and above a plurality of filament guide rings in said oiling frame, said oil nozzle assemblage comprising a frame, two ends of which each being formed of a laterally projected flat plate parallel to and engageable with a plane on a hook-shaped member and each being fixedly attached to said hook-shaped member;

said hook-shaped members each having a pivot hole opposite to said plane thereof, allowing said hook-shaped member to be pivotally attached to a fixing bracket fixedly attached to an inner side of a sidewall oiling apparatus; and said frame of said oil nozzle assemblage attached to said hook-shaped member being pivotally turnable with said hook-shaped member and thereby being adjustable to a desirable inclined angle.

2. An oiling apparatus for chemical fibre machines as claimed in claim 1, wherein said blades each have a sharp edge formed at a side adjacent to said fibre strand guide groove, and wherein said blade slideways each have sharp edges so ass to produce a shear effect with the sharp edge of the blade so that fibre strands containing broken filaments passing therethrough shall be cut at three cutting points formed between said sharp edge of said blade and said sharp edges of said blade slideways.

3. An oiling apparatus for chemical fibre machines as claimed in claim 1, wherein an assemblage of said cutting member and said blade cover set is mounted below said oiling device.

4. An oiling apparatus for chemical fibre machines as claimed in claim 1, further comprising an airflow guide board located at a position above said adjustable angle oiling device and is inclined such that said airflow guide board guides said cooling air and irregular airflow caused by said fibre strands moving downward at high speed so that such airflow blows in a fixed and steady direction toward said fibre strands.

* * * * *